US012305907B2

(12) United States Patent
Tang et al.

(10) Patent No.: US 12,305,907 B2
(45) Date of Patent: May 20, 2025

(54) CARBON DIOXIDE HEAT PUMP EVAPORATOR

(71) Applicant: JIANGSU SUJING GROUP CO., LTD., Jiangsu (CN)

(72) Inventors: Xiaoliang Tang, Jiangsu (CN); Dan Xiong, Jiangsu (CN); Hao Pan, Jiangsu (CN); Qiang Kang, Jiangsu (CN); Xiaofei Song, Jiangsu (CN); Hao Qiu, Jiangsu (CN); Bin Chen, Jiangsu (CN)

(73) Assignee: JIANGSU SUJING GROUP CO., LTD., Jiangsu (CN)

( * ) Notice: Subject to any disclaimer, the term of this patent is extended or adjusted under 35 U.S.C. 154(b) by 102 days.

(21) Appl. No.: 18/042,992

(22) PCT Filed: Aug. 30, 2021

(86) PCT No.: PCT/CN2021/115262
§ 371 (c)(1),
(2) Date: Feb. 24, 2023

(87) PCT Pub. No.: WO2022/083288
PCT Pub. Date: Apr. 28, 2022

(65) Prior Publication Data

US 2023/0358460 A1 Nov. 9, 2023

(30) Foreign Application Priority Data

Oct. 21, 2020 (CN) ..... 202011129579.3

(51) Int. Cl.
*F25D 21/14* (2006.01)
*F25B 39/02* (2006.01)
(Continued)

(52) U.S. Cl.
CPC ..... *F25D 21/14* (2013.01); *F25B 39/02* (2013.01); *F25B 47/00* (2013.01); *F25D 21/006* (2013.01);
(Continued)

(58) Field of Classification Search
CPC ..... F25D 21/006; F25D 2400/04; F25D 2700/12; F25D 21/02; F25B 2700/2117; F25B 2600/112; F25B 2400/01
See application file for complete search history.

(56) References Cited

U.S. PATENT DOCUMENTS 11,493,260 B1 * 11/2022 Carden ..... F25D 21/008
2017/0131005 A1 5/2017 Park et al.
(Continued)

FOREIGN PATENT DOCUMENTS

CN 2921730 Y * 7/2007
CN 206930010 U 1/2018
(Continued)

OTHER PUBLICATIONS

International Search Report and Written Opinion issued for International Patent Application No. PCT/CN2021/115262, dated Oct. 28, 2021 in 11 pages.

*Primary Examiner* — Nelson J Nieves
*Assistant Examiner* — Meraj A Shaikh
(74) *Attorney, Agent, or Firm* — Knobbe Martens Olson & Bear LLP

(57) ABSTRACT

Disclosed is a carbon dioxide heat pump evaporator, comprising side evaporators having defrosting water flow channels formed thereon, an evaporator tray which is arranged at the bottoms of the side evaporators and is used for supporting the side evaporators, and a defrosting drainage system, wherein the defrosting drainage system comprises a plurality of defrosting electric heating tubes inserted into the side
(Continued)

evaporators, water receiving gutters which are connected to the defrosting water flow channels, gutter electric heating mechanisms for heating the water receiving gutters, and drainage pipes which are connected to the water receiving gutters and are provided with conduit electric heating tracing bands; and the evaporator tray, the water receiving gutters and the drainage pipes are sequentially arranged from top to bottom. The carbon dioxide heat pump evaporator is suitable for low-temperature areas, especially for areas of extreme cold, and has the characteristics of a short defrosting time, smooth drainage, etc.

10 Claims, 4 Drawing Sheets

(51) Int. Cl.

| | |
|---|---|
| ***F25B 47/00*** | (2006.01) |
| ***F25D 21/00*** | (2006.01) |
| ***F25D 21/02*** | (2006.01) |
| ***F25D 21/08*** | (2006.01) |

(52) U.S. Cl.
CPC ..... *F25D 21/02* (2013.01); *F25D 21/08* (2013.01); *F25B 2400/01* (2013.01); *F25B 2700/11* (2013.01)

(56) References Cited

U.S. PATENT DOCUMENTS

| | | | | |
|---|---|---|---|---|
| 2019/0120513 | A1* | 4/2019 | Tamaki | F25B 13/00 |
| 2022/0049857 | A1* | 2/2022 | Shimazaki | F24F 13/30 |
| 2023/0194144 | A1* | 6/2023 | Song | F25D 21/08 62/140 |

FOREIGN PATENT DOCUMENTS

| | | | | | |
|---|---|---|---|---|---|
| CN | 108548349 | A | | 9/2018 | |
| CN | 109282541 | A | * | 1/2019 | F24F 11/42 |
| CN | 112097412 | A | | 12/2020 | |
| CN | 213273263 | U | | 5/2021 | |
| JP | 2002-310519 | | | 10/2002 | |
| WO | WO-2022037716 | A1 | * | 2/2022 | |

* cited by examiner

CARBON DIOXIDE HEAT PUMP EVAPORATOR

CROSS-REFERENCE TO RELATED APPLICATIONS

This application is the U.S. National Phase under 35. U.S.C. § 371 of International Application PCT/CN2021/115262, filed Aug. 30, 2021, which claims priority to Chinese Patent Application No. 202011129579.3, filed Oct. 21, 2020. The disclosures of the above-described applications are hereby incorporated by reference in their entirety.

TECHNICAL FIELD OF THE INVENTION

The present disclosure relates to a heat pump evaporator, specifically to a carbon dioxide heat pump evaporator.

BACKGROUND OF THE INVENTION

Due to the characteristics of the refrigerant itself, the air-source carbon dioxide heat pump has the characteristics of environmental protection, low temperature resistance, and higher temperature water output, and has attracted more and more attention from the market. The air-source carbon dioxide heat pump can produce water at a temperature of up to 90° C. or more at one time, and can normally produce high-temperature hot water at −30° C. cold temperature, so when compared with conventional air-source heat pumps, it has incomparable advantages; however, when the ambient temperature is low and the surface temperature of the fin heat exchangers in the side evaporators of the carbon dioxide heat pump evaporator is lower than 0° C., the surface of the fin heat exchangers is prone to frost, and with the continuous thickening of the frost layer, the heat transfer thermal resistance increases, resulting in a decrease in the heat exchange performance of the unit, so it is necessary to defrost in time. At present, air-source carbon dioxide heat pumps mostly use hot-gas bypass defrosting, which directly bypasses the higher temperature refrigerant discharged from the compressor and then leads to the inside of the evaporator, so that the frost layer on the surface of the fins melts. However, due to that the hot gas bypass defrosting only uses the heat generated by the compressor itself, the defrosting time is relatively long, and the defrosting effect is not ideal when the ambient temperature is relatively low, and the defrosting water generated during the defrosting process flows into the water receiving gutters through the evaporator tray, and in severe cold temperatures, the defrosting water has not been discharged and has been frozen for the second time, and repeatedly, the ice in the water receiving gutters will accumulate thicker and thicker. In severe cases, it will contact the fin heat exchangers, which will affect the heat exchange of the unit, and even damage the heat exchanger and cause refrigerant leakage.

SUMMARY OF THE INVENTION

The present disclosure is aimed to overcome the deficiencies in the prior art, and provide an improved carbon dioxide heat pump evaporator, which can solve the shortcomings of the existing carbon dioxide heat pump system, such as long defrosting time and poor drainage when the existing carbon dioxide heat pump system operates at a low ambient temperature.

To achieve the above purpose, a technical solution employed by the present disclosure is:

A carbon dioxide heat pump evaporator, which comprises a fixed base, side evaporators respectively arranged at left and right sides of the fixed base and having defrosting water flow channels formed thereon, an evaporator tray which is arranged at the bottoms of the side evaporators and is used for supporting the side evaporators, and a defrosting drainage system, wherein the defrosting drainage system comprises a plurality of defrosting electric heating tubes inserted into the side evaporators, a water receiving gutter which is connected to the defrosting water flow channels, a gutter electric heating mechanism for heating the water receiving gutter, and a drainage pipe which is connected to the water receiving gutter and is provided with a pipeline electric heating tracing band, and the evaporator tray, the water receiving gutter and the drainage pipe are sequentially arranged from top to bottom.

According to some preferred aspects of the present disclosure, the carbon dioxide heat pump evaporator further comprises a control system and a temperature sensor for detecting the ambient temperature, the control system is respectively connected in communication with the defrosting electric heating tubes, the gutter electric heating mechanism, the pipeline electric heating tracing band and the temperature sensor.

According to some preferred aspects of the present disclosure, the use method of the defrosting drainage system is as follows: when the temperature sensor detects that the ambient temperature is greater than or equal to T1, the defrosting electric heating tubes, the gutter electric heating mechanism and the pipeline electric heating tracing band do not work; when the temperature sensor detects that the ambient temperature is less than T1, defrosting starts, the defrosting electric heating tubes, the gutter electric heating mechanism and the pipeline electric heating tracing band start heating, and after the defrosting is completed, the defrosting electric heating tubes are powered off, and the gutter electric heating mechanism and the pipeline electric heating tracing band stop working after a delay of t time.

According to some preferred aspects of the present disclosure, the delay time t varies according to different ambient temperatures, when T2≤ambient temperature<T1, the gutter electric heating mechanism and the pipeline electric heating tracing band are powered off after a delay of t1 time; when T3≤ambient temperature<T2, the gutter electric heating mechanism and the pipeline electric heating tracing band are powered off after a delay of t2 time; when ambient temperature<T3, the gutter electric heating mechanism and the pipeline electric heating tracing band are powered off after a delay of t3 time.

According to some preferred and specific aspects of the present disclosure, T1 is −1 to 1° C., T2 is −6 to −4° C., T3 is −12 to −8° C., t1 is 55-65 s, t2 is 115-125 s, t3 is 170-190 s.

According to some preferred and specific aspects of the present disclosure, each of the side evaporators comprises $A_n$ evaporation branches, and the plurality of defrosting electric heating tubes is respectively inserted in any of the $A_n$th evaporation branches.

According to some preferred aspects of the present disclosure, the plurality of defrosting electric heating tubes is arranged according to the following rules: the nth defrosting electric heating tube from bottom to top is inserted in the $A_n$th evaporation branch, and satisfies: $A_n=n+(n-1)(n-2)/2$.

According to some preferred aspects of the present disclosure, the carbon dioxide heat pump evaporator further comprises a gutter bottom plate disposed at the bottom of the water receiving gutter and used for supporting the water receiving gutter.

According to some implementations of the present disclosure, the water receiving gutter is connected to the evaporator tray by bolts.

According to some implementations of the present disclosure, the water receiving gutter comprises a threaded drainage port, the drainage pipe is provided with a threaded fastener which matches the threads of the drainage port to realize fastening, and the drainage port is connected with the threaded fastener.

According to some preferred aspects of the present disclosure, the gutter electric heating mechanism is arranged at the outside bottom of the water receiving gutter, and the carbon dioxide heat pump evaporator further comprises thermal insulation cotton wrapped on the outer wall of the water receiving gutter, and the gutter electric heating mechanism is located between the water receiving gutter and the thermal insulation cotton.

According to some preferred and specific aspects of the present disclosure, the fixed base is a V-shaped fixed plate.

According to some preferred and specific aspects of the present disclosure, the carbon dioxide heat pump evaporator comprises a left evaporator, a right evaporator, a left water receiving gutter, a right water receiving gutter, a left gutter electric heating mechanism, a right gutter electric heating mechanism, a left drainage pipe, a right drainage pipe and a tail drainage pipe, the left evaporator, the left water receiving gutter and the left drainage pipe are connected in sequence, the right evaporator, the right water receiving gutter and the right drainage pipe are connected in sequence, and the tail drainage pipe is respectively connected to the left drainage pipe and the right drainage pipe, the left gutter electric heating mechanism is arranged at the outside bottom of the left water receiving gutter, and the right gutter electric heating mechanism is arranged at the outside bottom of the right water receiving gutter.

Due to the use of the above technical solutions, the present disclosure has the following advantages over the prior art:

The present disclosure innovatively replaces part of the evaporation branches with defrosting electric heating tubes in the original evaporator structure, and at the same time adds electric heating equipment on the water receiving gutters and the drainage pipes, it solves the problem that the defrosting time is too long due to the hot gas bypass defrosting when the carbon dioxide heat pump is running at a low ambient temperature, and is beneficial to reduce the energy consumption of defrosting, improve the comprehensive low-temperature performance of the carbon dioxide heat pump, and facilitate the smooth drainage of defrosting water at low temperature, and it is especially suitable for severe cold areas, its overall structure is simple and all adjustments are made in the existing structure, which is easy to promote; at the same time, combined with the level of ambient temperature and the defrosting state of the system, intelligently control of start and stop and running time of defrosting electric heating, water receiving gutter electric heating and pipeline heating tracing bands is beneficial to reduce defrosting energy consumption.

BRIEF DESCRIPTION OF THE DRAWINGS

For more clearly explaining the technical solutions in the embodiments of the present disclosure or the prior art, the accompanying drawings used to describe the embodiments are simply introduced in the following. Apparently, the below described drawings merely show a part of the embodiments of the present disclosure, and those skilled in the art can obtain other drawings according to the accompanying drawings without creative work

Figure 1:
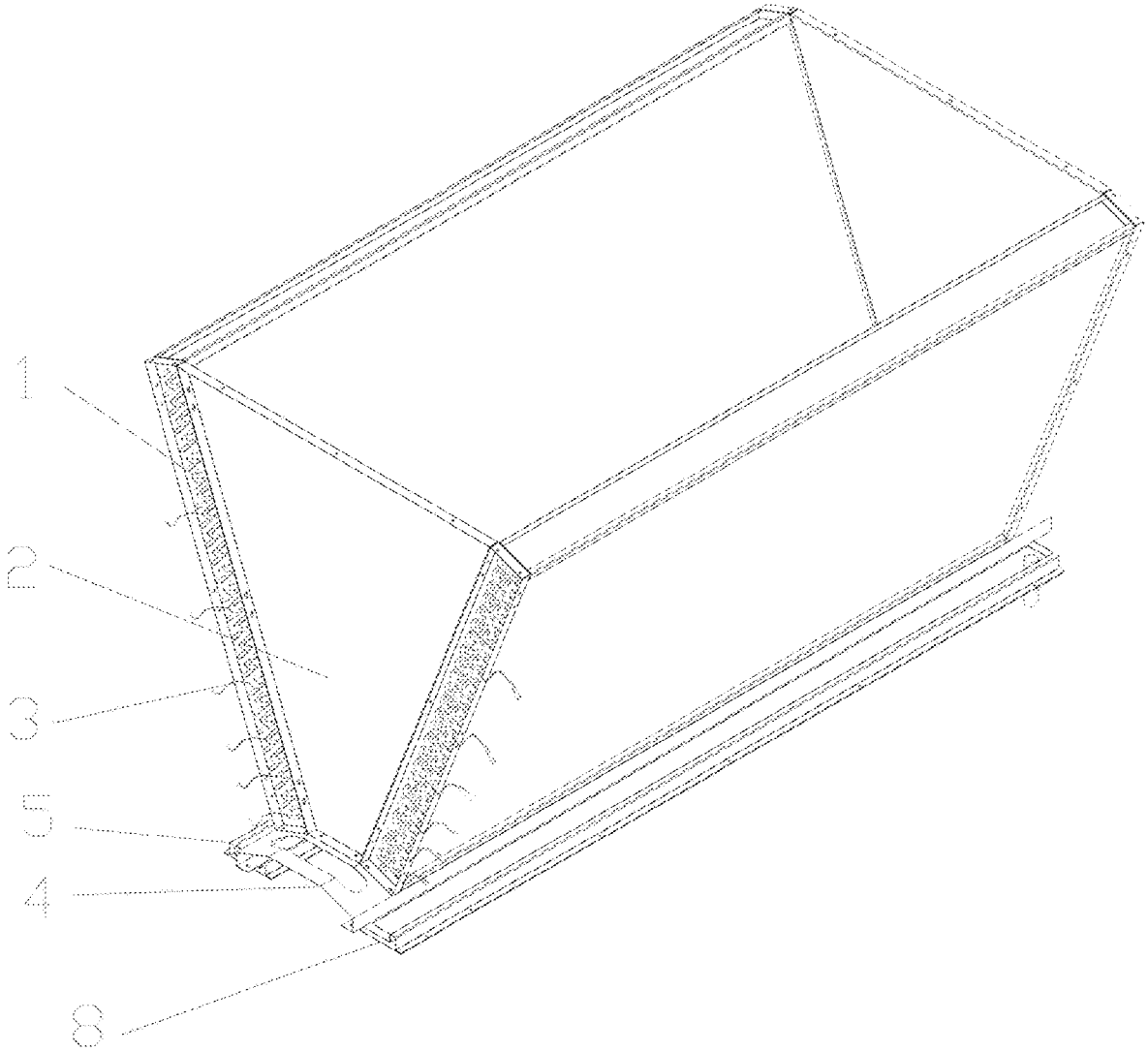
FIG. 1 is a schematic structure diagram of a carbon dioxide heat pump evaporator in an embodiment of the present disclosure.

wherein, 1, side evaporator; 2, fixed base; 3, defrosting electric heating tube; 4, evaporator tray; 5, water receiving gutter; 6, gutter electric heating mechanism; 7, thermal insulation cotton; 8, gutter bottom plate; 9, drainage pipe; 10, pipeline electric heating tracing band; 11, tail drainage pipe; a and b respectively represent a drainage port.

DETAILED DESCRIPTION OF EXEMPLARY EMBODIMENTS

In order to make the above objects, features and advantages of the present disclosure more clearly understood, the present disclosure will be described in detail below with reference to the accompanying drawings and specific embodiments. In the following description, numerous specific details are set forth in order to provide a thorough understanding of the present disclosure. However, the present disclosure can be implemented in many other ways different from those described herein, and those skilled in the art can make similar improvements without departing from the connotation of the present disclosure, therefore, the present disclosure is not limited by the specific embodiments disclosed below.

In the description of the present disclosure, "a plurality of" means at least two, such as two, three, etc., unless otherwise expressly and specifically defined.

In the present disclosure, unless otherwise expressly specified and limited, the terms "mount", "communicate", "connect", "fix" and other terms should be understood in a broad sense, for example, it may be fixedly connected or detachably connected, or integrated; it may be mechanically connected or electrically connected; it can be directly connected or indirectly connected through an intermediate medium, or it can be the internal communication of two elements or the interaction relationship between two elements, unless otherwise specified limit. For those of ordinary skill in the art, the specific meanings of the above terms in the present disclosure can be understood according to specific situations.

In the disclosure, unless otherwise expressly specified and limited, a first feature "on" or "under" a second feature may mean that the first feature is in direct contact with the second feature, or the first feature is in indirect contact with the second feature through an intermediate medium. Also, the first feature being "above", "over" the second feature may mean that the first feature is directly above or obliquely above the second feature, or simply means that the first feature is level higher than the second feature. The first feature being "under", "below" and "underneath" the second feature may mean that the first feature is directly below or obliquely below the second feature, or simply means that the first feature has a lower level than the second feature.

It should be noted that when an element is referred to as being "fixed to" or "disposed on" another element, it can be directly on the other element or intervening elements may also be present. When an element is referred to as being "connected to" another element, it can be directly connected to the other element or intervening elements may also be present.

In the following, the preferred embodiments of the present disclosure are explained in detail combining with the accompanying drawings.

As shown in FIG. 1 to FIG. 6, this embodiment provides a carbon dioxide heat pump evaporator for a carbon dioxide heat pump, and the carbon dioxide heat pump evaporator comprises a fixed base 2, side evaporators 1 respectively arranged at left and right sides of the fixed base 2 and having defrosting water flow channels formed thereon, an evaporator tray 4 arranged at the bottoms of the side evaporators 1 and used for supporting the side evaporators 1, and a defrosting drainage system. The defrosting drainage system comprises a plurality of defrosting electric heating tubes 3 inserted into the side evaporators 1, a water receiving gutter 5 in communication with the defrosting water flow channels, a gutter electric heating mechanism 6 for heating the water receiving gutter 5, and a drainage pipe 9 which is connected to the water receiving gutter 5 and is provided with a pipeline electric heating tracing band 10 (can prevent the drainage pipe 9 from being blocked by ice, etc.), and the evaporator tray 4, the water receiving gutter 5 and the drainage pipe 9 are sequentially arranged from top to bottom.

Figure 2:
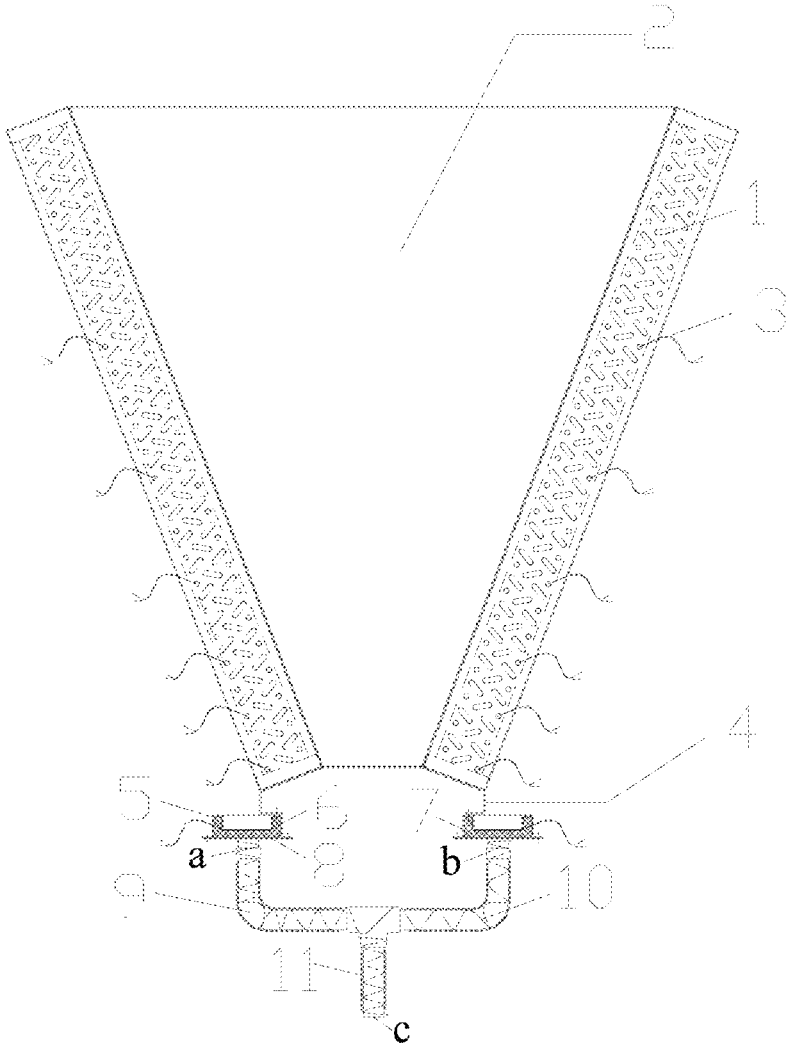
FIG. 2 is a schematic side view of a carbon dioxide heat pump evaporator in an embodiment of the present disclosure.
Figure 3:
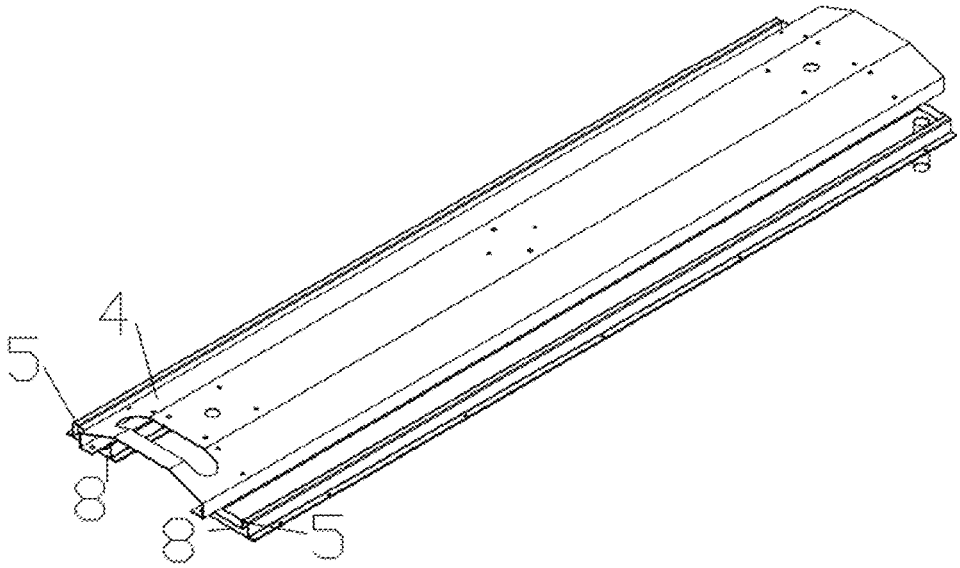
FIG. 3 is a schematic diagram of the matching of the evaporator tray, the water receiving gutter and the gutter bottom plate in an embodiment of the present disclosure.
Figure 4:
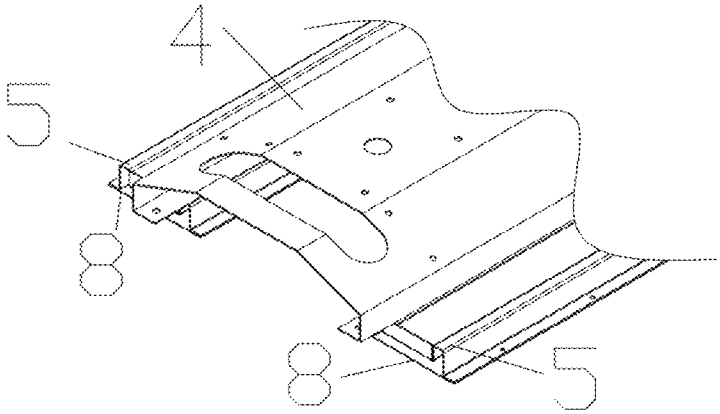
FIG. 4 is an enlarged schematic view of the end portion in FIG. 3.
Figure 5:
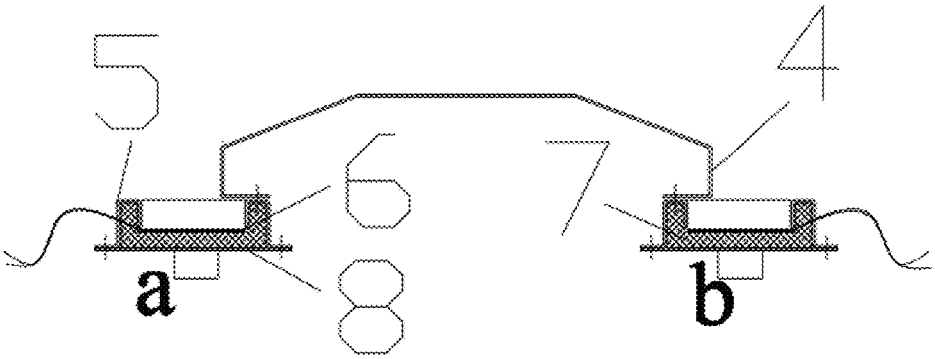
FIG. 5 is a partial enlarged schematic view of the water receiving gutter in FIG. 2.

Specifically, as shown in FIG. 1 and FIG. 2, the fixed base 2 is a V-shaped fixed plate, of course, the V-shape in this embodiment is not necessarily designed strictly according to the V-shape, but it is a V-shape as a whole, for example, it may also be an inverted trapezoid with a short bottom side, the two side evaporators 1 are respectively arranged on the waists of the inverted trapezoid, and the evaporator tray 4 is arranged on the relatively short bottom of the inverted trapezoid; the defrosting electric heating tubes 3 are inserted into the spaces in the side evaporators 1, and these spaces can be the gaps between the fins of the side evaporators 1, so that it is conducive to the direct conduction of heat to the fins, so that the frost layer on the surface of the fins melts, and the melted liquid fluid, generally defrosting water, flows directly down the defrosting water flow channel and flows out through the defrosting drainage system. Further, in this embodiment, there is a plurality of defrosting electric heating tubes 3, which can be evenly distributed in the gaps between the fins of the side evaporators 1 on the left and right sides, for example, as shown in FIG. 2, the defrosting water flows from top to bottom, and the defrosting water may freeze again in the process of flowing out due to that the temperature is low, therefore, the plurality of defrosting electric heating tubes 3 can be arranged to present a distribution state with a sparse upper part and a dense lower part on each side evaporator 1, that is, a small amount of defrosting electric heating tubes 3 can be arranged in the upper part, more defrosting electric heating tubes 3 can be arranged in the lower part, and the distance between two adjacent defrosting electric heating tubes 3 in the lower part can be provided to be smaller, so that a better defrosting effect can be obtained.

In other embodiments, the defrosting electric heating tubes 3 can also be arranged on the side evaporators 1 at equal intervals and in equal numbers, and each defrosting electric heating tube 3 can be powered on and off independently, and then the required defrosting electric heating tubes 3 can be activated respectively according to the actual defrosting effect.

As an optional implementation, in this embodiment, each of the side evaporators 1 comprises $A_n$ evaporation branches, and the above plurality of defrosting electric heating tubes 3 is respectively inserted in any of the $A_n$th evaporation branches; further, in this embodiment, the plurality of defrosting electric heating tubes 3 is arranged according to the following rules: the nth defrosting electric heating tube 3 from bottom to top is inserted in the $A_n$th evaporation branch, and satisfies: $A_n=n+(n-1)(n-2)/2$; the overall feature is "dense at the bottom and sparse at the top", which can improve the defrosting performance of the carbon dioxide heat pump at low ambient temperature; in addition, the defrosting electric heating tubes 3 in this embodiment can be connected in a star-shaped manner, where n is a multiple of 3. Specifically, in this embodiment, a defrosting electric heating tubes 3 can replace one of the original evaporation branches (also called pipelines), and the plurality of defrosting electric heating tubes 3 occupy the positions of a plurality of original evaporation branches (also called pipelines).

In this embodiment, the carbon dioxide heat pump evaporator further comprises a control system and a temperature sensor for detecting the ambient temperature, the control system is respectively connected in communication with the defrosting electric heating tubes 3, the gutter electric heating mechanism 6, the pipeline electric heating tracing band 10 and the temperature sensor, and through the control system, the start and stop of each device can be accurately controlled, which is convenient to improve work efficiency.

In this embodiment, as shown in FIGS. 1-4, the carbon dioxide heat pump evaporator further comprises a gutter bottom plate 8 disposed at the bottom of the water receiving gutter 5 and used for supporting the water receiving gutter 5, which improves stability and facilitates the connection to other components.

Specifically, in this embodiment, there are two water receiving gutters 5 arranged opposite to each other and are respectively connected with the evaporator tray 4 by bolts. At the same time, the water receiving gutters 5 on the left and right sides of this embodiment respectively comprise a drainage port with threads (as shown in FIG. 2, including drainage port a and drainage port b), the drainage pipes 9 are provided with threaded fasteners which match the threads of the drainage ports to realize fastening, the drainage ports is connected with the threaded fasteners, so that the replacement of the drainage pipe 9 is convenient, and the connection between the two components is simpler, which is beneficial to the operation.

Further, in this embodiment, the gutter electric heating mechanisms 6 are arranged at the outside bottoms of the water receiving gutters 5, and the carbon dioxide heat pump evaporator further comprises thermal insulation cotton 7 wrapped on the outer walls of the water receiving gutters 5, and the gutter electric heating mechanisms 6 are located between the water receiving gutters 5 and the thermal insulation cotton 7. This arrangement, on the one hand, prevents the heat generated by the gutter electric heating mechanisms 6 from dissipating too quickly, and on the other hand ensures that the gutter electric heating mechanisms 6 can closely fit the bottoms of the water receiving gutters 5 to improve the heating effect.

Specifically, as shown in FIG. 2, the carbon dioxide heat pump evaporator in this embodiment is roughly left-right symmetrical in structure, and comprises a left evaporator, a right evaporator, a left water receiving gutter, a right water receiving gutter, a left gutter electric heating mechanism, a right gutter electric heating mechanism, a left drainage pipe, a right drainage pipe and a tail drainage pipe 11. The left evaporator, the left water receiving gutter and the left drainage pipe are connected in sequence, and the right evaporator, the right water receiving gutter and the right drainage pipe are connected in sequence, and the tail drainage pipe is respectively in connected to the left drainage pipe and the right drainage pipe, the left gutter electric heating mechanism is arranged at the outside bottom of the left water receiving gutter, and the right gutter electric heating mechanism is arranged at the outside bottom of the right water receiving gutter.

Figure 6:
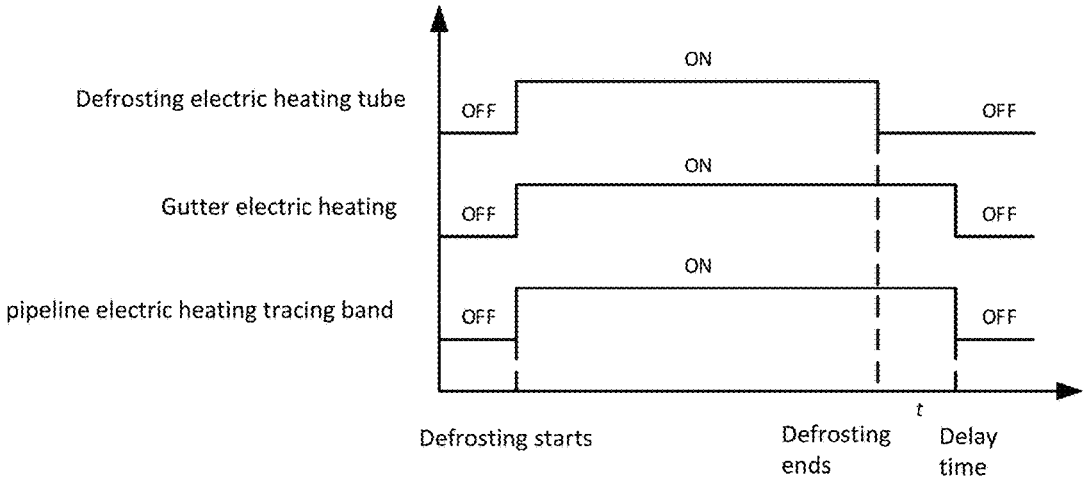
FIG. 6 is the control sequence diagram adopted by the use method of the defrosting drainage system according to an embodiment of the present disclosure.

The use method of the defrosting drainage system is as follows: FIG. 6 shows a system control sequence diagram used in this embodiment, when the system is started, when the temperature sensor detects that the ambient temperature is greater than or equal to T1, the defrosting electric heating tubes 3, the gutter electric heating mechanisms 6 and the pipeline electric heating tracing bands 10 do not work; when the temperature sensor detects that the ambient temperature is less than T1, defrosting starts, the defrosting electric heating tubes 3, the gutter electric heating mechanisms 6 and the pipeline electric heating tracing bands 10 start heating, and after the defrosting is completed, the defrosting electric heating tubes 3 are powered off, and the gutter electric heating mechanisms 6 and the pipeline electric heating tracing bands 10 stop working after a delay of t time;

Wherein, the delay time t varies according to different ambient temperatures, when T2≤ambient temperature<T1, the gutter electric heating mechanisms 6 and the pipeline electric heating tracing bands 10 are powered off after a delay of t1 time; when T3≤ambient temperature<T2, the gutter electric heating mechanisms 6 and the pipeline electric heating tracing bands 10 are powered off after a delay of t2 time; when ambient temperature<T3, the gutter electric heating mechanisms 6 and the pipeline electric heating tracing bands 10 are powered off after a delay of t3 time.

In this embodiment, under certain regional conditions, T1 is −1 to 1° C., T2 is −6 to −4° C., T3 is −12 to −8° C., t1 is 55-65 s, t2 is 115-125 s, t3 is 170-190 s; specifically, T1 can be 0° C., T2 can be −5° C., T3 can be −10° C., t1 can be 60 s, t2 can be 120 s, t3 can be 180 s. Of course, for different regions, the temperature of T1-T3 can be different, and t1-t3 can also be different.

To sum up, the present disclosure innovatively replaces part of the evaporation branches with defrosting electric heating tubes 3 in the original evaporator structure, and at the same time adds electric heating equipment on the water receiving gutters 5 and the drainage pipes 9, it solves the problem that the defrosting time is too long due to the hot gas bypass defrosting when the carbon dioxide heat pump is running at a low ambient temperature, and is beneficial to reduce the energy consumption of defrosting, improve the comprehensive low-temperature performance of the carbon dioxide heat pump, and facilitate the smooth drainage of defrosting water at low temperature, and it is especially suitable for severe cold areas, its overall structure is simple and all adjustments are made in the existing structure, which is easy to promote; at the same time, combined with the level of ambient temperature and the defrosting state of the system, intelligently control of start and stop and running time of defrosting electric heating, water receiving gutter electric heating and pipeline heating tracing bands is beneficial to reduce defrosting energy consumption. Therefore, the carbon dioxide heat pump evaporator of the present disclosure is suitable for low temperature regions, especially for severe cold regions, and has the characteristics of short defrosting time and smooth drainage, etc.

The embodiments described above are only for illustrating the technical concepts and features of the present disclosure, and are intended to make those skilled in the art being able to understand the present disclosure and thereby implement it, and should not be concluded to limit the protective scope of this disclosure. Any equivalent variations or modifications according to the spirit of the present disclosure should be covered by the protective scope of the present disclosure.

What is claimed is:

1. A carbon dioxide heat pump evaporator, comprising:

side evaporators having defrosting water flow channels formed thereon;

a defrosting drainage system;

a controller; and a temperature sensor for detecting the ambient temperature;

wherein the defrosting drainage system comprises a plurality of defrosting electric heating tubes inserted into the side evaporators;

a water receiving gutter which is connected to the defrosting water flow channels, a gutter electric heater for heating the water receiving gutter; and a drainage pipe which is connected to the water receiving gutter, wherein the drainage pipe is provided with a pipeline electric heating tracing band, wherein the controller is respectively connected in communication with the plurality of defrosting electric heating tubes, the gutter electric heater, the pipeline electric heating tracing band, and the temperature sensor;

wherein the defrosting drainage system is configured such that:

when the temperature sensor detects that the ambient temperature is greater than or equal to T1, the plurality of defrosting electric heating tubes, the gutter electric heater and the pipeline electric heating tracing band do not work; and when the temperature sensor detects that the ambient temperature is less than T1, defrosting starts, the plurality of defrosting electric heating tubes, the gutter electric heater and the pipeline electric heating tracing band start heating, after defrosting is completed, the plurality of defrosting electric heating tubes are powered off, and the gutter electric heater and the pipeline electric heating tracing band stop working after a delay time t, wherein the delay time t varies according to different ambient temperatures such that:

when T2≤ambient temperature<T1, the gutter electric heater and the pipeline electric heating tracing band are powered off after a delay time t1;

when T3≤ambient temperature<T2, the gutter electric heater and the pipeline electric heating tracing band are powered off after a delay time t2; and when ambient temperature<T3, the gutter electric heater and the pipeline electric heating tracing band are powered off after a delay time t3.

2. The carbon dioxide heat pump evaporator according to claim 1, wherein T1 is −1 to 1° C., T2 is −6 to −4° C., T3 is −12 to −8° C., t1 is 55-65 s, t2 is 115-125 s, or t3 is 170-190 s.

3. The carbon dioxide heat pump evaporator according to claim 1, wherein each of the side evaporators comprises $A_n$ evaporation branches, and the plurality of defrosting electric heating tubes is respectively inserted in any one of the $A_n$ evaporation branches.

4. The carbon dioxide heat pump evaporator according to claim 3, wherein the plurality of defrosting electric heating tubes is arranged such that an nth defrosting electric heating tube of the plurality of defrosting electric heating tubes, counted from bottom to top, is inserted in a $B_n$th evaporation branch, wherein $B_n$ is a serial number of the $A_n$ evaporation branches, counted from bottom to top, and satisfies $B_n=n+(n-1)\times(n-2)/2$.

5. The carbon dioxide heat pump evaporator according to claim 1 further comprising:

an evaporator tray which is arranged at bottoms of the side evaporators and is used for supporting the side evaporators, and a gutter bottom plate which is disposed at a bottom of the water receiving gutter and is configured to be used for supporting the water receiving gutter and the evaporator tray, the water receiving gutter and the drainage pipe sequentially arranged from top to bottom.

6. The carbon dioxide heat pump evaporator according to claim 5, wherein the water receiving gutter is connected to the evaporator tray by bolts.

7. The carbon dioxide heat pump evaporator according to claim 1, wherein the water receiving gutter comprises a drainage port with threads, the drainage pipe is provided with a threaded fastener which matches the threads of the drainage port to realize fastening, and the drainage port is connected with the threaded fastener.

8. The carbon dioxide heat pump evaporator according to claim 1, wherein the gutter electric heater is arranged at an outside bottom of the water receiving gutter, the carbon dioxide heat pump evaporator further comprises thermal insulation cotton wrapped on an outer wall of the water receiving gutter, and the gutter electric heater is located between the water receiving gutter and the thermal insulation cotton.

9. The carbon dioxide heat pump evaporator according to claim 1, further comprising:

a left evaporator;

a right evaporator;

a left water receiving gutter;

a right water receiving gutter;

a left gutter electric heater;

a right gutter electric heater;

a left drainage pipe;

a right drainage pipe; and a tail drainage pipe, wherein the left evaporator, the left water receiving gutter, and the left drainage pipe are connected in sequence, wherein the right evaporator, the right water receiving gutter and the right drainage pipe are connected in sequence, wherein the tail drainage pipe is respectively connected to the left drainage pipe and the right drainage pipe, wherein the left gutter electric heater is arranged at an outside bottom of the left water receiving gutter, and the right gutter electric heater is arranged at an outside bottom of the right water receiving gutter.

10. The carbon dioxide heat pump evaporator according to claim 1 further comprising a fixed base, wherein the side evaporators are respectively arranged at left and right sides of the fixed base.

* * * * *